United States Patent [19]

Parrish

[11] 4,098,012

[45] Jul. 4, 1978

[54] AUGER-TYPE THIN-KEELED EXCAVATING MACHINE

[76] Inventor: Reuel C. Parrish, P.O. Box 1846, Enid, Okla. 73701

[21] Appl. No.: 818,539

[22] Filed: Jul. 25, 1977

Related U.S. Application Data

[63] Continuation-in-part of Ser. No. 712,601, Aug. 9, 1976, abandoned.

[51] Int. Cl.[2] ..... E02F 5/04

[52] U.S. Cl. ..... 37/82

[58] Field of Search ..... 37/81, 82

[56] References Cited

U.S. PATENT DOCUMENTS

| | | | |
|---|---|---|---|
| 202,200 | 4/1878 | Stewart | 37/81 |
| 814,982 | 3/1906 | Nixon | 37/81 |
| 919,595 | 4/1909 | Kessler | 37/81 |
| 2,381,689 | 8/1945 | Roehr | 37/81 |
| 2,545,016 | 3/1951 | Berry | 37/82 |
| 3,257,662 | 6/1966 | Smith | 37/81 |

FOREIGN PATENT DOCUMENTS

| | | | |
|---|---|---|---|
| 283,917 | 1/1971 | U.S.S.R. | 37/81 |
| 297,755 | 7/1971 | U.S.S.R. | 37/81 |

*Primary Examiner*—Clifford D. Crowder
*Attorney, Agent, or Firm*—William R. Laney

[57] ABSTRACT

A trench excavating machine which includes a self-propelled vehicle having a front end and including a prime mover drivingly connected to an auger mounted forwardly of the vehicle and extending in a generally vertical direction. The auger is rotatably mounted concentrically within a dirt shield of arcuate or generally semi-circular cross-sectional configuration, and is positioned within the dirt shield so that a leading side of the auger projects forwardly of the dirt shield. A helical blade constituting part of the auger is made to extend into a location immediately above, and at the forward side of, a very thin keel structure.

4 Claims, 6 Drawing Figures

AUGER-TYPE THIN-KEELED EXCAVATING MACHINE

RELATED APPLICATIONS

This application is a continuation-in-part of my U.S. application Ser. No. 712,601 filed Aug. 9, 1976, and entitled "Trench Excavating Machine," now abandoned.

BACKGROUND OF THE INVENTION

1. Field of the Invention

This invention relates to devices for continuously excavating an elongated, substantially linear trench, and more particularly, to trench excavating machines of a mobile or portable character which function to propagate or project a trench forwardly of a vehicle supporting the cutting or excavating element of the apparatus.

2. Brief Description of the Prior Art

A number of machines have previously been provided for quickly and continuously excavating a trench or ditch, and have included a wheel-mounted vehicle carrying a cutting element which continuously bites into and removes earth for the purpose of projecting the trench in a desired direction. Generally, such machines are capable of continuous operation to continuously project the trench along a line desired. Many include teeth or buckets mounted on some form of endless chain which is driven in rotation to bring the buckets into contact with the earth at the leading end of the trench for biting and scraping away earth to enlarge and project the trench.

There have also been proposed and patented, various excavating machines which include a rotary-driven auger mounted at the front of some type of prime mover or conveyance mechanism, with the auger having a pilot bit or some sort of ground excavating device located at the lower end of the auger, with the auger functioning both to extend a trench and to elevate dirt from the trench to ground level. Patents of this type are those which are shown in Saumenig U.S. Pat. No. 3,443,326 and Nixon U.S. Pat. No. 814,982. Auger trench excavators mounted at the rear of the vehicle or prime mover are also shown in Fullard U.S. Pat. No. 785,302, Kessler U.S. Pat. No. 919,595, Stewart U.S. Pat. No. 202,200 and Swedish Pat. No. 155,459. A device of this sort is also shown in French Pat. No. 1,224,143 and in Berry U.S. Pat. No. 2,545,016.

It is necessary in all trench excavating machines of the type which utilize or depend upon a rotated auger or screw-type cutting member to cut away and lift the dirt, to support such cutting element at its lower end in some type of bearing or journal which will permit rotation of the screw or auger blade. To the extent that such journal or bearing offers resistance to the forward movement of the auger blade as the trench is extended horizontally in the earth, the efficiency of the machine is decreased and the expediency with which the trench may be extended and completed is reduced.

Bearings or journals of the type described have, in some instances, been mounted in flat supporting shoes or plates which are provided at their forward end with a sharp cutting edge. Two devices of this character are shown in Hanneborg U.S. Pat. No. 530,687 and Nixon U.S. Pat. No. 814,982. In the case of both of these machines, the broad expanse of the shoe, though reduced to a slight extent in its frictional resistance to movement through the earth by the formation of a cutting edge on the forward side thereof, nevertheless offers significant resistance to the advance of the auger into the earth at the forward side of the trench, and reduces the speed with which the trench can be dug and completed. Moreover, the helically turned blade of the auger, in each instance, terminates in a relatively blunt, substantially horizontal lower end, so that the cutting efficiency of the blade is reduced at this location.

In my U.S. pat. application Ser. No. 712,601, of which the present application constitutes a continuation-in-part, I have described an improved trench excavating machine which utilizes an auger assembly having a helically turned blade for the purpose of accomplishing the primary earth cutting and removal function of the apparatus. The helical blade is secured around an elongated shaft which is supported at its lower end in a bearing or journal which is positioned atop a keel structure located at the lower end of the blade. I have now determined that while the apparatus described in my co-pending parent application works well in practice, the efficiency with which the auger excavator can be projected through the earth is reduced due to the drag which is developed at the lower end of the auger at the auger-keel connection. It is with respect to this structure that the present invention constitutes an improvement.

BRIEF DESCRIPTION OF THE PRESENT INVENTION

The present invention provides a trench excavating machine or apparatus which relies primarily, for effective digging and trenching action, upon the inclined plane principle incorporated in a substantially vertically extending auger. The auger includes a helical blade which contacts and drills or cuts away the earth at the leading side of the auger as the auger is forcibly advanced against the leading end of the trench during operation of the apparatus. The machine is of relatively simple mechanical construction, and is efficient in its digging and trenching capabilities.

Broadly described, the trench excavating apparatus of the invention comprises a self-propelled vehicle which has an auger mounted on the vehicle. Frame means of suitable structure is mounted on the vehicle, and supports the auger and an associated dirt shield at a location suitable for control and viewing by the vehicle operator, and for placement and guidance to form and to project the trench in the direction desired. The auger is rotatably mounted concentrically within a generally vertically extending, semi-cylindrical dirt shield. The shield is mounted on the frame means, and includes a pair of opposed edges extending substantially parallel to each other on opposite sides of the auger. The auger includes a leading side which projects forwardly of the opposed edges of the dirt shield, and suitable means are provided for driving the auger in rotation.

A keel structure is secured to the rear lower side of the dirt shield for the purpose of steering or guiding the auger during its cutting action in the course of projecting the trench being excavated, and for the purpose of providing an auger-supporting and bearing structure at the lower end of the auger. The auger includes a helical cutting blade secured around a shaft which has its lower end journaled upon the upper side of the keel structure by a bearing subassembly. The blade terminates in a radial cutting edge at its lower end and this cutting edge is immediately adjacent the upper side of the keel structure.

An important object of the present invention is to provide a trench excavating apparatus which is of relatively simple mechanical construction, can be easily operated from a vehicle on which it is mounted and which functions effectively for the purpose of forming and projecting a trench in the earth.

Another object of the invention is to provide a trench excavating apparatus which is highly efficient in removing and displacing dirt from a trench being formed by the apparatus so that the dirt does not interfere with the cutting and trenching action of the apparatus.

A further very important object of the invention is to provide a trench excavating apparatus which utilizes a substantially vertically extending, horizontally advanced auger which cooperates with a guiding and supporting keel structure which offers minimum resistance to movement of the apparatus into and through the earth.

Additional objects and advantages of the invention will become apparent as the following detailed description of a preferred embodiment of the invention is read in conjunction with the accompanying drawings which illustrate such preferred embodiment.

GENERAL DESCRIPTION OF THE DRAWINGS

DETAILED DESCRIPTION OF A PREFERRED EMBODIMENT OF THE INVENTION

Figure 1:
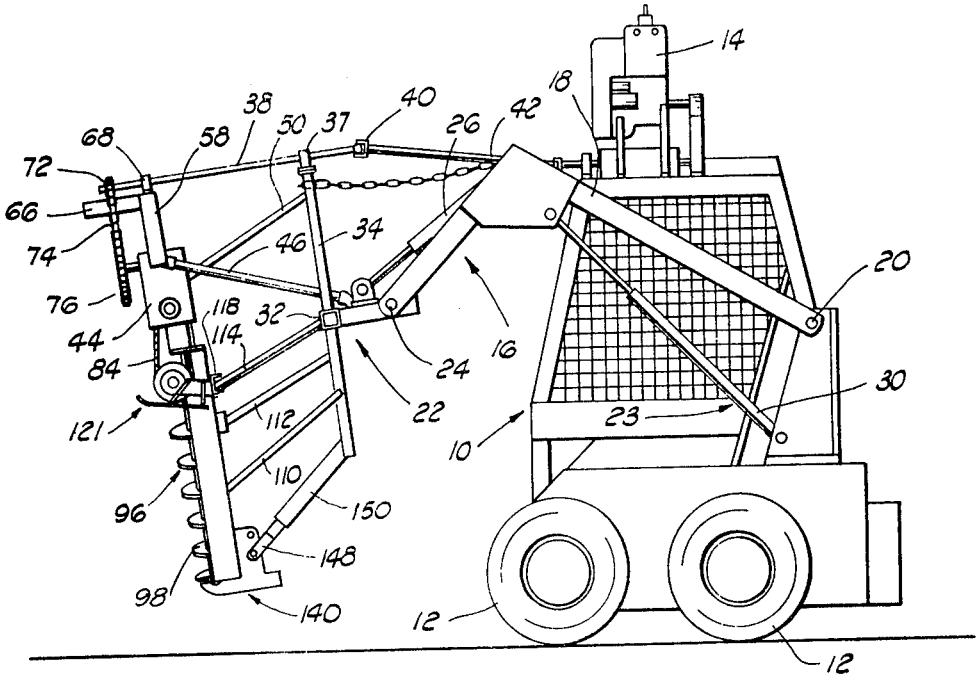
FIG. 1 is a side elevation view of one embodiment of a trench excavating apparatus constructed in accordance with one embodiment of the invention.
Figure 2:
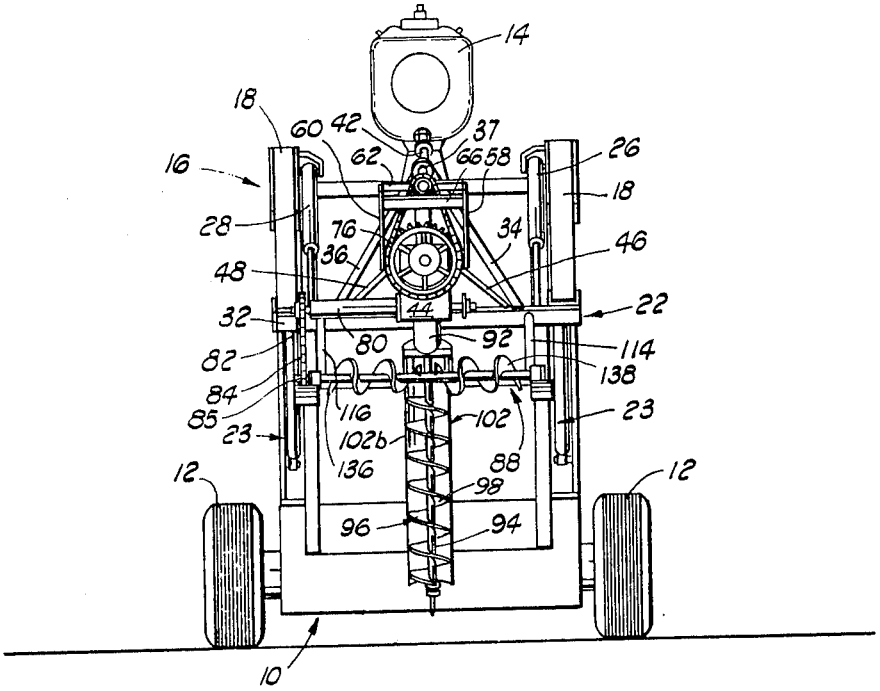
FIG. 2 is a front elevation view of the trench excavating apparatus illustrated in FIG. 1.

Referring initially to FIG. 1 of the drawings, shown therein is a self-propelled vehicle 10 supported upon a plurality of ground-engaging pneumatic tires 12. The self-propelled vehicle 10 has a prime mover 14 supported at some suitable location thereon, and further has secured thereto a forwardly projecting framework designated generally by reference numeral 16. The illustrated framework 16 is an articulated structure which includes a pair of horizontally spaced, L-shaped arms 18 pivotally connected to the vehicle 10 as shown at 20 and carrying at the forward ends of the arms a subframe designated generally by reference numeral 22. Pivotation of the L-shaped arms 18 is effected by means of a pair of piston and cylinder subassemblies 23 mounted on the vehicle 10. The subframe 22 is susceptible to pivotation about a horizontal axis shown at 24 by means of a pair of hydraulic piston and cylinder subassemblies 26 and 28 (see FIGS. 1 and 2).

It will be perceived from the description of the invention thus far that the excavating and cutting elements mounted forwardly on the vehicle on the framework 16 and subframe 22 can be manipulated in their orientation with respect to the ground by elevating and lowering the forward ends of the L-shaped arms 18 using the piston and cylinder subassemblies 23 and by pivoting the subframe 22 about the horizontal axis 24 by means of the piston and cylinder subassemblies 26 and 28.

The subframe 22 includes a transversely extending main supporting bar 32 which has projecting upwardly from points longitudinally spaced therealong, a pair of convergent frame elements 34 and 36. At their upper ends, the convergent frame elements 34 and 36 support a shaft journal 37 for journaling an elongated forward drive shaft 38. The forward drive shaft 38 is connected through a universal joint 40 to a rear drive shaft 42 which is suitably coupled to the output shaft from the prime mover 14. A gear box 44 is supported forwardly of the main supporting bar 32 on the subframe 22 by means of brace rods 46 and 48 which project to the opposite sides of the gear box from the bar 32, and by a brace rod 50 which projects downwardly to the back side of the gear box from the frame elements 34 and 36. A pair of opposed, substantially parallel, horizontally spaced supporting plates 58 and 60 are welded to opposite sides of the gear box, and project upwardly therefrom. The plates 58 and 60 are interconnected by a transverse brace plate 62 at the upper end thereof, and function, with this plate, to support a rectangular frame element 66 and a journal element 68 which rotatably journals the forward end of the forward drive shaft 38. At the forward end of the forward drive shaft 38, a chain sprocket 72 is keyed to the drive shaft and drivingly engages a chain 74 which is used for driving a relatively large sprocket 76 keyed to an input shaft extending into the gear box 44.

Appropriate gearing disposed in the gear box 44 is used for driving a horizontally extending output shaft 80 which carries at its outer end a toothed chain sprocket 82 used for driving a chain 84. The chain 84 is passed around a sprocket 85 mounted at one end of the shaft 86 of a transverse dirt removing auger subassembly designated generally by reference numeral 88. A second output shaft (not visible) projects downwardly from the gear box 44 within a sleeve 92 and is drivingly connected to the upper end of the shaft 94 of an elongated, generally vertically extending auger subassembly, designated generally by reference numeral 96. The auger subassembly 96, in addition to the elongated vertically extending shaft 94 includes a helical blade flight 98 which spirals upwardly around the shaft 94, and terminates below the lower end of the shaft in a manner hereinafter described.

Figure 3:
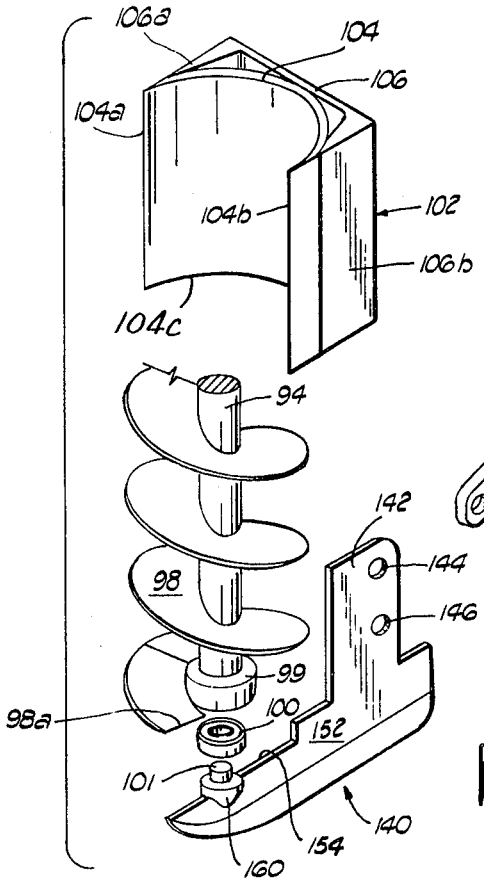
FIG. 3 is an exploded view of part of the auger and keel subassemblies as they appear in perspective and separated from each other for purposes of illustration.
Figure 4:
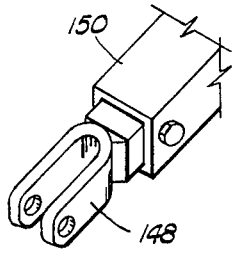
FIG. 4 is a side elevation view of portions of the auger and keel subassemblies as they appear at their point of interconnection to each other.
Figure 4:
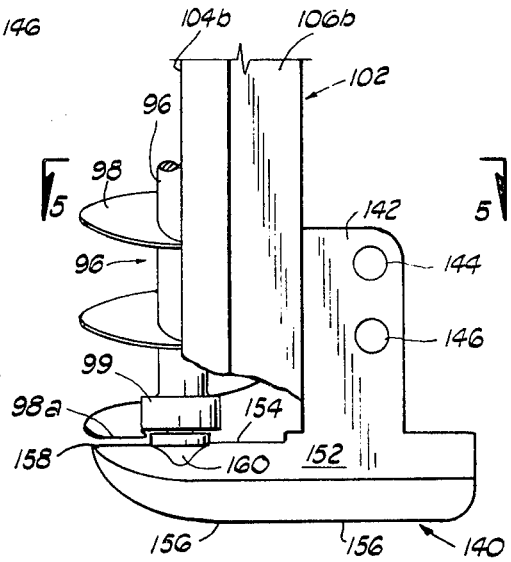
Figure 6:
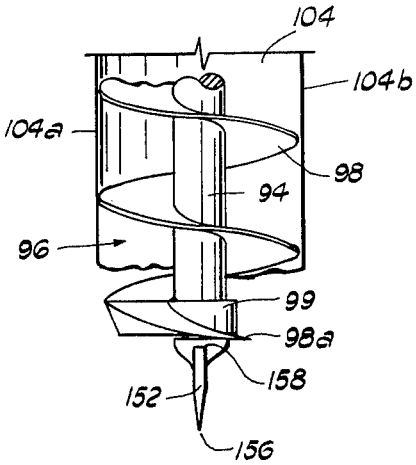
FIG. 6 is a front elevation view of the lower end of the auger subassembly and forward side of the keel subassembly, and illustrating a portion of the dirt shield used in the apparatus of the invention as it appears when broken away at its lower end.
Figure 5:
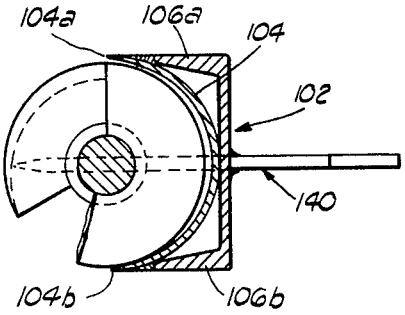
FIG. 5 is a sectional view taken along line 5—5 of FIG. 4, with a portion of the helical blade constituting a part of the auger subassembly removed so that the lower terminus of the helical blade can be viewed from above.

As shown in FIGS. 3–6, the lower end of the shaft 94 of the auger subassembly 96 terminates in a hub 99 which includes a cavity on its lower side receiving an annular bearing race 100. The bearing race 100 has an outer part which contacts the side of the cavity in the hub 99 and an inner part which is movable relative to the outer part. The inner part of the bearing race 100 is bored or apertured to receive a pin 101 which projects upwardly from the upper edge of a very thin or blade-type keel plate to be hereinafter described. The manner in which the pin 101, bearing race 100 and hub 99 are joined to each other in a bearing subassembly is best illustrated in FIGS. 3, 4 and 6 of the drawings.

A semi-cylindrical dirt shield assembly 102 is mounted at the back side of the hellical blade flight 98 and includes a generally semi-cylindrical shield plate 104 which conforms to the generally circular configuration of the horizontal cross-section of the helical blade flight 98, and is positioned immediately to the rear of the blade flight. The shield plate 104 terminates in a pair of sharp forward edges **104*a* and 104*b* which define a dirt-receiving opening, and are located on opposite sides of the helical blade flight 98 and slightly to the rear of a plane extended through the axis of the shaft 94. Reinforcement for the shield plate 104 is provided by a channel element 106 which includes a pair of legs 106*a* and 106*b* which taper to edges at the forward side thereof which merge into the opposed sides of the shield plate 104, so that a single plane is defined by the outer sides of the leading portions of the shield plate 104 and the outer surfaces of the legs 106*a* and 106*b* of the reinforcing element 106**.

At its rear side, the dirt shield assembly 102 is supported on the subframe 22 by a plurality of brace rods 110 and 112. Additional horizontally spaced brace rods 114 and 116 project forwardly and downwardly from the main supporting bar 32, and are secured at their forward ends to a transverse beam 118 which has its central portion welded to the back side of the semicylindrical dirt shield assembly 102. A pair of skid assemblies 121 which include runners are supported from opposite ends of the transverse beam 118.

Journaled upon the shaft 86 are a pair of oppositely turned helical flights 136 and 138. The helical flights 136 and 138 project inwardly to a location adjacent the top of the helical blade flight 98 carried on the shaft 94 of the vertically extending auger assembly 96, and function in a manner hereinafter described to displace dirt, elevated by the vertically extending auger assembly, to oppostie sides of a trench being formed by the trench excavating machine of the invention.

An important aspect of the present invention is the manner in which the auger assembly 96 is mounted upon a keel structure which is disposed therebelow, and which rotatably supports the shaft 94 for rotation about a substantially vertical axis. The very thin keel plate utilized in the present invention is depicted in FIGS. 3–6 and is designated generally by reference numeral 140. As will be apparent in referring to FIGS. 4 and 6, the transverse vertical dimension or height of the keel plate is at least three times the thickness of the keel plate as measured horizontally therethrough. The keel plate 140 includes a vertically extending flange 142 adapted to be secured to the web portion of the reinforcing element 106 directly behind the shield plate 104 and in line with the axis of the shaft 94. Securing of the flange 142 to the reinforcing element 146 can be by welding or any other suitable means. The flange 142 carries a pair of vertically spaced apertures 144 and 146 which are utilized for receiving a bolt employed for connecting the flange to a clevis bracket 148. The clevis bracket 148 is carried at one end of a bar 150 which has its opposite end connected to a crossbar extending between the lower ends of the frame elements 34 and 36. Slight adjustment in the verticality of the auger assembly 96 can be achieved by selection of the appropriate aperture 144 or 146 for connection of the clevis bracket to the keel plate 140.

The keel plate 140 further includes a substantially horizontally extending runner portion 152 which has a stepped or relieved upper side which forms a shaft-supporting edge 154 at the forward end thereof. At its lower side, the horizontal runner portion 152 of the keel plate 140 tapers to a knife edge 156 as illustrated in FIGS. 4 and 6, and the runner portion terminates in a point 158 at the forward end thereof. It will be noted that the location of the point 158 of the keel plate 140 is just slightly to the rear of the leading edge of the helical blade 98. The pin 101, to which reference has previously been made, is welded or otherwise suitably secured to a boss 160 provided on the upper edge 154 of the horizontally extending runner portion 152 of the keel plate.

It will be noted in referring to FIGS. 3, 4 and 6 that the helical blade flight 98 of the auger assembly 96 is secured at its radially inner side to the shaft 94 over the length of the shaft, and then is secured at its inner side to the outer periphery of the hub 99 at the lower end of this shaft. It will further be noted that the lowermost end of the helical blade flight 98 projects below the lowermost portion of the hub 99, so that this end of the blade lies in a plane which is opposite the top of the boss 160. The lower end of the blade 98 terminates in a sharp edge **98*a* which projects in a line substantially normal to the rotational axis of the shaft 94, and which terminates at its opposite ends in points on the blade. It will also be observed in referring to FIGS. 4 and 6 that the edge 98*a* is disposed in a horizontal plane which lies immediately above the plane occupied by the upper edge 154 of the runner portion 152 of the keel plate 140, and at least as low as the lowermost edge 104*c* of the shield plate 104**.

OPERATION

In the operation of the trench excavating machine of the invention, any suitable supporting vehicle can be utilized for mounting and transporting the excavating elements of the apparatus of the invention, provided only that the vehicle can accommodate a prime mover suited for driving the several auger elements of the structure in rotation, and can accommodate a suitable framework upon which the excavating elements can be supported for vertical elevation and lowering of the auger assembly 96, and preferably, for canting or swinging this auger assembly about a horizontal axis so that it is oriented at any desired inclination with respect to the vertical.

In the embodiment of the invention illustrated herein, the L-shaped arms 18 and framework 16 are pivoted downwardly, and the subframe 22 is pivoted downwardly about the axis 24, as needed, to bring the lower end of the vertically extending auger subassembly 96 into contact with the earth. At this time, the initial attitude of the shaft 94 and the helical blade flight 98 which it carries will most frequently be vertical, although in some instances, where the earth is too hard for the keel plate 140 to penetrate into the earth the few inches necessary to permit the blade 98 to commence to act upon the earth, the auger assembly may be tilted very slightly so that the shaft extends at an angle of from about 10° to about 20° to the vertical. This attitude will be maintained only long enough to permit the helical blade flight 98 to commence to bite into the earth, after which time the auger assembly will be restored to a vertical attitude.

At the commencement of operation, the prime mover 14 is started and, through the rear drive shaft 42, universal joint 40 and forward drive shaft 48, causes the chain sprocket 72 to be driven in rotation, thereby driving the chain 74 and sprocket 76. The horizontally extending output shaft 80 from the gear box 44 is driven in rotation, and functions to drive the shaft 86 of the transverse dirt-removing auger subassembly 88 through the interconnecting chain 84.

Concurrently, the second output shaft from the gear box 44 is driven in rotation to drive the elongated, vertically extending shaft 94 of the vertically extending auger subassembly 96 in rotation. Typically, the rotational speed of the auger subassembly can be from around 250 rpm to about 450 rpm. The operator of the vehicle 10 then commences to move the vehicle forward, and at the same time, actuates the hydraulic cylinders of the piston and cylinder subassemblies 26, 28 and 30 as required to cause the vertically extending auger subassembly 96 to bite into the earth. The direction of rotation of the helical blade flight 98, and its pitch and orientation on the elongated, vertically extending shaft 94 are such that, as dirt is cut away by the lower end of the blade flight on the commencement of the formation of the trench, the dirt is elevated by the helical blade and is confined during elevation within the semi-cylindrical dirt shield 102 provided with the vertically extending, substantially parallel edges 104*a* and 104*b* disposed on opposite sides of the auger subassembly 96.

Continued advancement of the vehicle 10 conjunctively with the excavating action of the vertically extending auger subassembly 96 deepens and advances the trench being formed. Ultimately, a trench of predetermined depth will be formed at the time that the skid subassemblies 121 are positioned with the runners thereof sliding along the surface of the earth on opposite sides of the trench. At this time, the trench is advanced at a constant depth, and earth which is cut away at the leading end of the trench by the helical blade flight 98 is forced upwardly by the turning blade flight and the confining action of the dirt shield assembly 102. When the removed dirt reaches the top of the vertically extending auger subassembly 96, it is picked up by the two oppositely acting helical flights 136 and 138 of the transverse dirt-removing auger subassembly, and it is then moved outwardly to opposite sides of the trench.

The cooperation of the dirt shield subassembly 102 with the helical blade flight 98 of the vertically extending subassembly 96 permits the trench to be advanced more rapidly, and the sides thereof to be more smoothly formed, than with conventional trenching devices. Quite importantly also, the manner in which the helical blade flight 98 of the auger subassembly 96 is mounted on the shaft 94, and the shaft 94 in turn supported upon the keel plate 140, substantially reduces the mechanical and frictional resistance to forward advance of the trench-forming apparatus of the invention. The reason for the reduction in resistance to the advance of the apparatus in the trench being formed is that a cutting action is provided around a major portion of the structure which is required to support this cutting element. The helical blade flight 98 is extended as low as it is possible to extend it before it is required to be interrupted and terminated by the presence of the supporting keel plate 140 which extends in a substantially vertical plane. Thus, as previously pointed out, the lower edge 98*a* of the helical blade flight 98 terminates at a plane which lies immediately above the plane occupied by the upper edge 154 of the keel plate 140. Dirt which might tend to bear against the hub 99 and bearing race 100 is therefore continuously cut away by the revolving lower end portion of the helical blade flight 98, and particularly, by the slicing action of the sharpened lower edge 98*a* of this blade flight. This arrangement also functions to protect the bearing or journal constituted by the pin 101, bearing race 100 and hub 99 from impaction by dirt. Lastly, the very thin nature of the keel plate 140, coupled with its sharpened lower edge 156 and its pointed nose at the forward end thereof, assure that the keel plate will offer minimum resistance to the forward advance of the cutting elements of the trench excavating apparatus, while continuing to function as a guiding and stabilizing structure.

Although certain preferred embodiments of the invention have been herein described in order to provide an explanation of the manner in which certain basic principles are employed in the invention, it will be understood that various changes and innovations can be effected in the illustrated and described embodiments without departure from such basic principles. Modifications and changes of this type are therefore deemed to be circumscribed by the spirit and scope of the invention, except as the same may be necessarily limited by the appended claims or reasonable equivalents thereof.

What is claimed is:

1. Excavating apparatus comprising:

an auger assembly including:

an upwardly extending shaft;

a flat, vertically extending keel plate below the shaft having an upper edge directly below the shaft, a sharpened lower edge and a point at the upper forward terminus of said upper edge;

a bearing subassembly rotatably supporting the shaft on the upper edge of the keel plate, said bearing assembly comprising:

a hub secured to the lower end of the shaft;

a pin secured to the upper edge of said keel plate; and bearing means between and interengaging said pin and said hub for rotatably supporting the shaft on the upper edge of the keel plate;

a helical blade spiralling around and affixed to the shaft and having a lower end portion at least partially around and radially outside the bearing subassembly and terminating in a lower edge located immediately above the horizontal plane containing the upper edge of the keel plate, said helical blade having a leading, forwardmost edge of said helical blade which is forward of the point at the upper forward side of the keel plate at the forward terminus of said upper edge whereby said leading forwardmost edge of the helical blade encounters the earth being removed during excavation prior to the time that said point contacts the earth;

said keel plate point being offset rearwardly from the leading forwardmost edge of said helical blade, and said keel plate having a transverse vertical dimension which is at least three times its thickness;

a semi-circular dirt shield plate extending around the rear side of said auger assembly adjacent said helical blade and extending substantially parallel to said shaft and terminating in a lower edge which is no lower than said lower edge of said helical blade;

a vehicle adapted for horizontal movement over the ground; and means movably supporting the auger assembly on the vehicle for vehicle movement and pivotal movement about a horizontal axis.

2. Excavating apparatus as defined in claim 1 wherein said helical blade terminates in a sharp edge extending substantially normal to said shaft and positioned below said hub.

3. Excavating apparatus as defined in claim 1 wherein said keel plate includes a vertically extending flange connected to said dirt shield.

4. Excavating apparatus comprising:

an auger assembly including:

an upwardly extending shaft;

a keel plate below the shaft having an upper edge directly below the shaft, said keel plate being a flat, vertically extending plate having a sharpened lower edge and a point at the upper forward side of the keel plate at the forward terminus of said upper edge, said keel plate having a transverse vertical dimension which is at least three times its thickness;

a bearing subassembly rotatably supporting the shaft on the upper edge of the keel plate; and a helical blade spiralling around and affixed to the shaft and having a lower end portion at least partially around and radially outside and bearing subassembly and terminating in a lower edge located immediately above the horizontal plane containing the upper edge of the keel plate, said helical blade having a leading, forwardmost edge of said helical blade which is forward of the point at the upper forward side of the keel plate at the forward terminus of said upper edge whereby said leading forwardmost edge of the helical blade encounters the earth being removed during excavation prior to the time that said point contacts the earth;

a semi-circular dirt shield plate extending around the rear side of said auger assembly adjacent said helical blade and extending substantially parallel to the shaft and terminating in a lower edge which is no lower than said lower edge of said helical blade;

a vehicle adapted for horizontal movement over the ground; and means movably supporting the auger assembly on the vehicle for vertical movement and pivotal movement about a horizontal axis.

* * * * *